US006379124B1

(12) United States Patent
Lai

(10) Patent No.: US 6,379,124 B1
(45) Date of Patent: Apr. 30, 2002

(54) AIR PUMP STRUCTURE HAVING DRIVING EFFECT

(76) Inventor: Chi-Shih Lai, 1F, No. 91, Lane 259, Szu Wei Rd., Panchiao, Taipei Hsien (TW)

( * ) Notice: Subject to any disclaimer, the term of this patent is extended or adjusted under 35 U.S.C. 154(b) by 0 days.

(21) Appl. No.: 09/737,563

(22) Filed: Dec. 18, 2000

(51) Int. Cl.[7] ..... F04B 17/00; F04B 43/00; F21V 33/00

(52) U.S. Cl. ..... 417/410.1; 417/412; 362/101

(58) Field of Search ..... 417/410.1, 313, 417/412, 413.1, 415; 362/101

(56) References Cited

U.S. PATENT DOCUMENTS 5,993,021 A * 11/1999 Lin ..... 362/101
6,007,307 A * 12/1999 Sonoda ..... 417/312
6,065,850 A * 5/2000 Chiu ..... 362/101
6,276,669 B1 * 8/2001 Yang ..... 261/30

* cited by examiner

*Primary Examiner*—Timothy S. Thorpe
*Assistant Examiner*—Michael K. Gray
(74) *Attorney, Agent, or Firm*—Rosenberg, Klein & Lee

(57) ABSTRACT

The present invention proposes an air pump structure having driving effect. The present invention is characterized in that a swing element of the air pump is connected to a driving shaft. One end of the driving shaft has a poked part protruding out of a shell body of the air pump. Except having air-supplying function, the air pump of the present invention can drive a color disk or other devices of a water lamp. Another motor is not required for driving the color disk to rotate, thereby saving the cost of another motor. Moreover, the structure of the whole water lamp can be much simplified, resulting in convenience in assembly and reduction in cost.

6 Claims, 6 Drawing Sheets

AIR PUMP STRUCTURE HAVING DRIVING EFFECT

FIELD OF THE INVENTION

The present invention relates to an air pump structure having driving effect and, more particularly, to an air pump structure, which is applicable to a water lamp and has air-supplying and driving effects.

BACKGROUND OF THE INVENTION

Air pumps are devices consuming electric power to transport air into water. Among all types of air pumps, vibration type air pumps are most commonly used. A vibration type air pump uses electromagnets to generate vibration, and then transports air into water by means of this vibration force to bring forth flow of water. Thereby, oxygen will be dissolved in water, and carbon dioxide will be discharged so that the amount of oxygen dissolved in water will increase to favor the existence of fishes.

There is already a kind of water lamp commercially available, which has a hollow container made of transparent material. Water and false fishes are arranged in the hollow container. An air pump, a color disk, a motor, and a light source are installed at the bottom of the container. The air pump can transport air into the water through an air pipe so that flow of water and air bubbles can be generated. Moreover, decorative articles such as false fishes will seem to swim in the water to build vivid visual effects. The color disk is made of transparent material, and has various kinds of variations of colors and patterns. The color disk can be driven to rotate by the motor. The light source is installed below the color disk. When the light source is turned on, light from the light source will pass through the color disk and then be projected to the container and the water so that shining effect will be exhibited in the container and the water. Therefore, novelty and variability can be obtained, and special visual effects can be exhibited. However, a prior art air pump has only the simple air-supplying function, and cannot drive the color disk of a water lamp. Another motor must be installed to drive the color disk to rotate. Therefore, except additional cost of another motor, the structure of the whole water lamp will be more complex, resulting in inconvenience in assembly and increase in cost.

SUMMARY OF THE INVENTION

The primary object of the present invention is to provide an air pump structure having driving effect. Except that the air pump has air-supplying functions a driving shaft protrudes to drive a color disk or other devices of a water lamp. Another motor is not required for driving the color disk to rotate, thereby saving the cost of another motor. Moreover, the structure of the whole water lamp will be much simplified, resulting in convenience in assembly and reduction in cost.

To achieve the above object, the present invention provides an air pump structure having driving effect, which comprises a shell body, a coil, a swing element, a magnet, a pump unit, and a driving shaft. The coil is installed in the shell body and is connected to a power wire. The swing element is installed in the shell body. The magnet is fixed at one end of the swing element, and adjoins the coil. The pump unit joins the swing element. The driving shaft is connected to the swing element. One end of the driving shaft has a poked part. The poked part protrudes out of the shell body. An air pump having driving effect is thus formed.

The various objects and advantages of the present invention will be more readily understood from the following detailed description when read in conjunction with the appended drawings, in which:

DETAILED DESCRIPTION OF THE PREFERRED EMBODIMENTS

Figure 1:
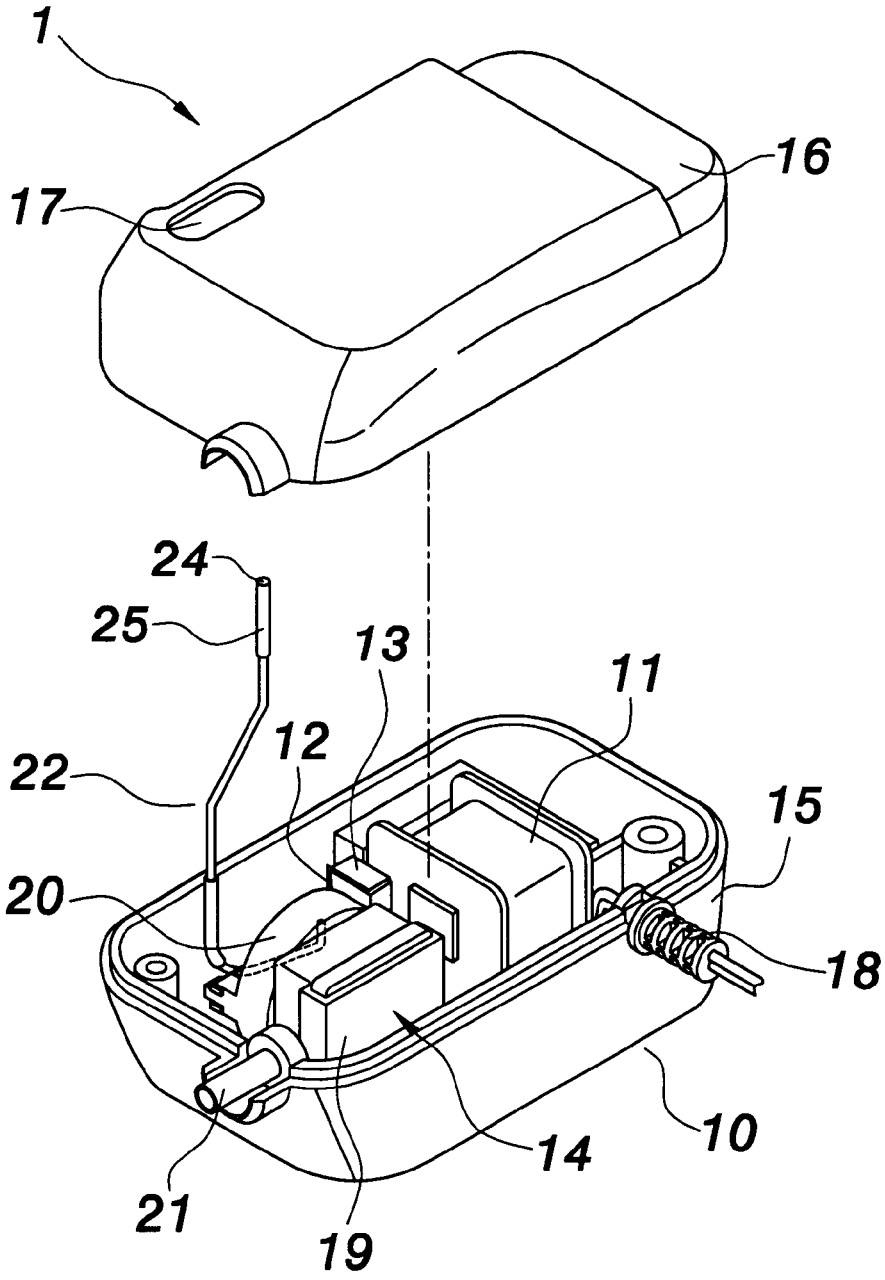
FIG. 1 is a perspective view of the air pump of the present invention.
Figure 2:
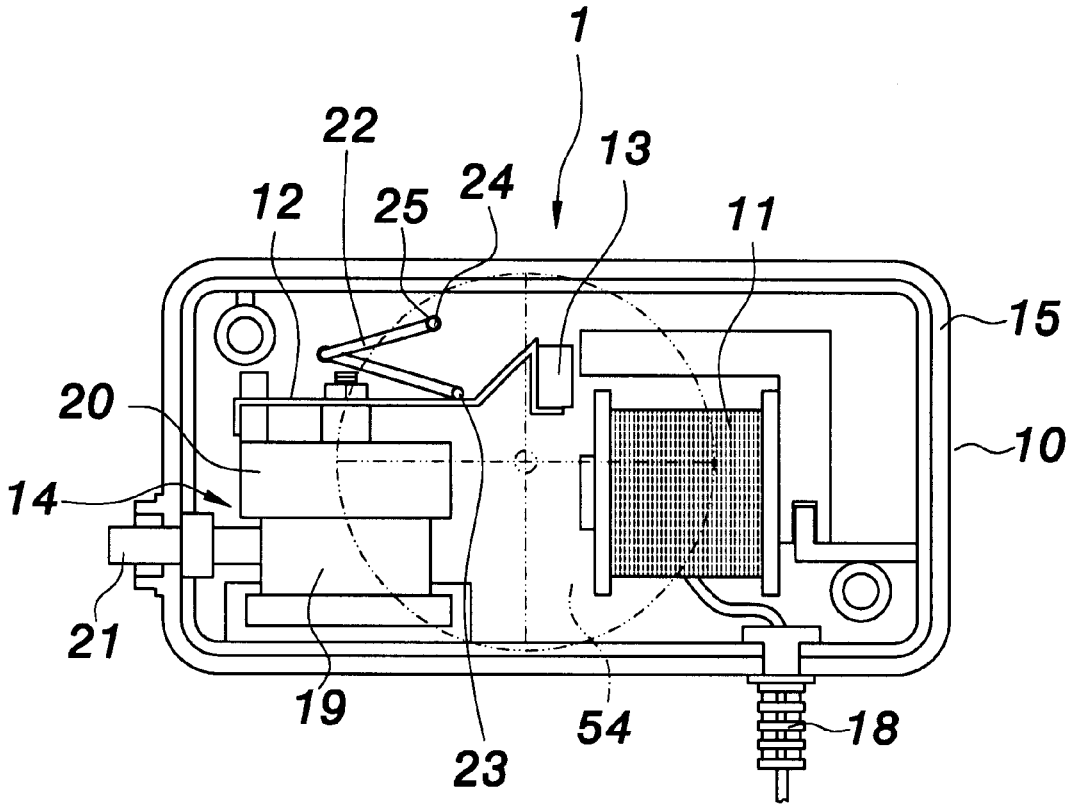
FIG. 2 is a plan view of the internal structure of the air pump of the present invention.

As shown in FIGS. 1 and 2, the present invention provides an air pump structure having driving effect. The air pump 1 comprises a shell body 10, a coil 11, a swing element 12, a magnet 13, and a pump unit 14. The shell body 10 comprises a lower shell 15 and an upper shell 16. The lower shell 16 and the upper shell 16 are joined by means of screwing so as to form the hollow shell body 10. A rectangular groove hole 17 is formed on the upper shell 16 of the shell body 10.

The coil 11 is fixedly installed in the shell body 10. The coil 11 is connected to a power wire 18 for inputting electricity so that it can generate electromagnetic effect. The swing element 12 is installed in the shell body 10. The magnet 13 is fixed at one end of the swing element 12 and adjoins the coil 11. When power is inputted to the coil 11 to generate magnetic field so that the magnet 13 and the coil 11 will generate fast reciprocating motion, one end of the swing element 12 will be driven to generate fast swing. The swing element 12 is also properly connected to the pump unit 14.

The pump unit 14 comprises an air room 19 and a cover body 20 made of rubber. The air room 19 is fixed in the shell body 10 and has proper valves (not shown) therein. An air outlet 21 extends from the air room 19. The cover body 20 is telescoped at one end of the air room 19. The pump unit 14 is connected to the swing element 12 through the cover body 20. When the swing element 12 generates fast swing to drive the cover body 20, air will be transported out from the air outlet 21 through the action of the air room 19.

The present invention is characterized in that the swing element 12 of the air pump 1 is connected to a roughly L-shaped driving shaft 22. One end of the driving shaft 22 has a connecting part 23 connected to the swing element 12 by means of welding. The other end of the driving shaft 22 has a poked part 24. A sheathing body 25 made of rubber can telescope outside the poked part 24. The poked part 24 of the driving shaft 22 protrudes out of the shell body 10 via the groove hole 17. An air pump structure having driving effect of the present invention is thus formed.

Figure 3:
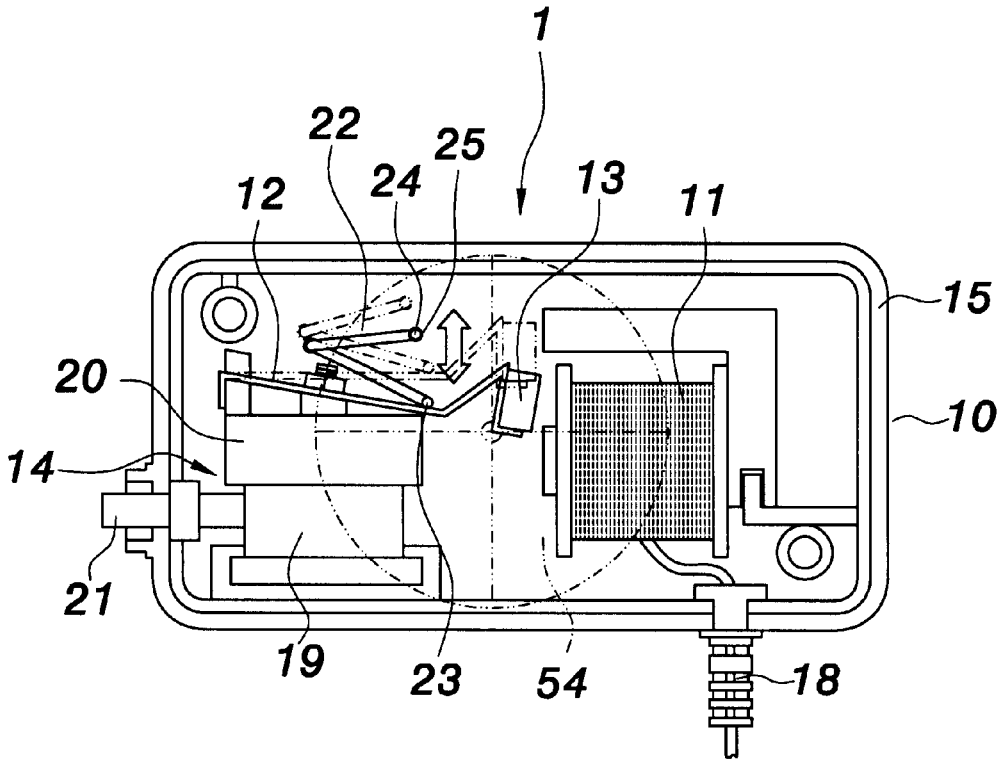
FIG. 3 is a diagram showing the action of the air pump of the present invention.

As shown in FIG. 3, when power is inputted to the coil 11 to generate magnetic field so that the magnet 13 will be attracted to generate fast reciprocating motion, one end of the swing element 12 will be driven to generate fast swing. The cover body 20 will be driven so that air will be transported out from the air outlet 21 through the action of the air room 19. Because the swing element 12 is connected to the driving shaft 22, when the swing element 12 generate fast swing, the driving shaft 22 will be jointly driven to generate fast swing. Therefore, the driving shaft 22 will form a power-output unit for driving other devices such as the color disk of a water lamp.

Figure 4:
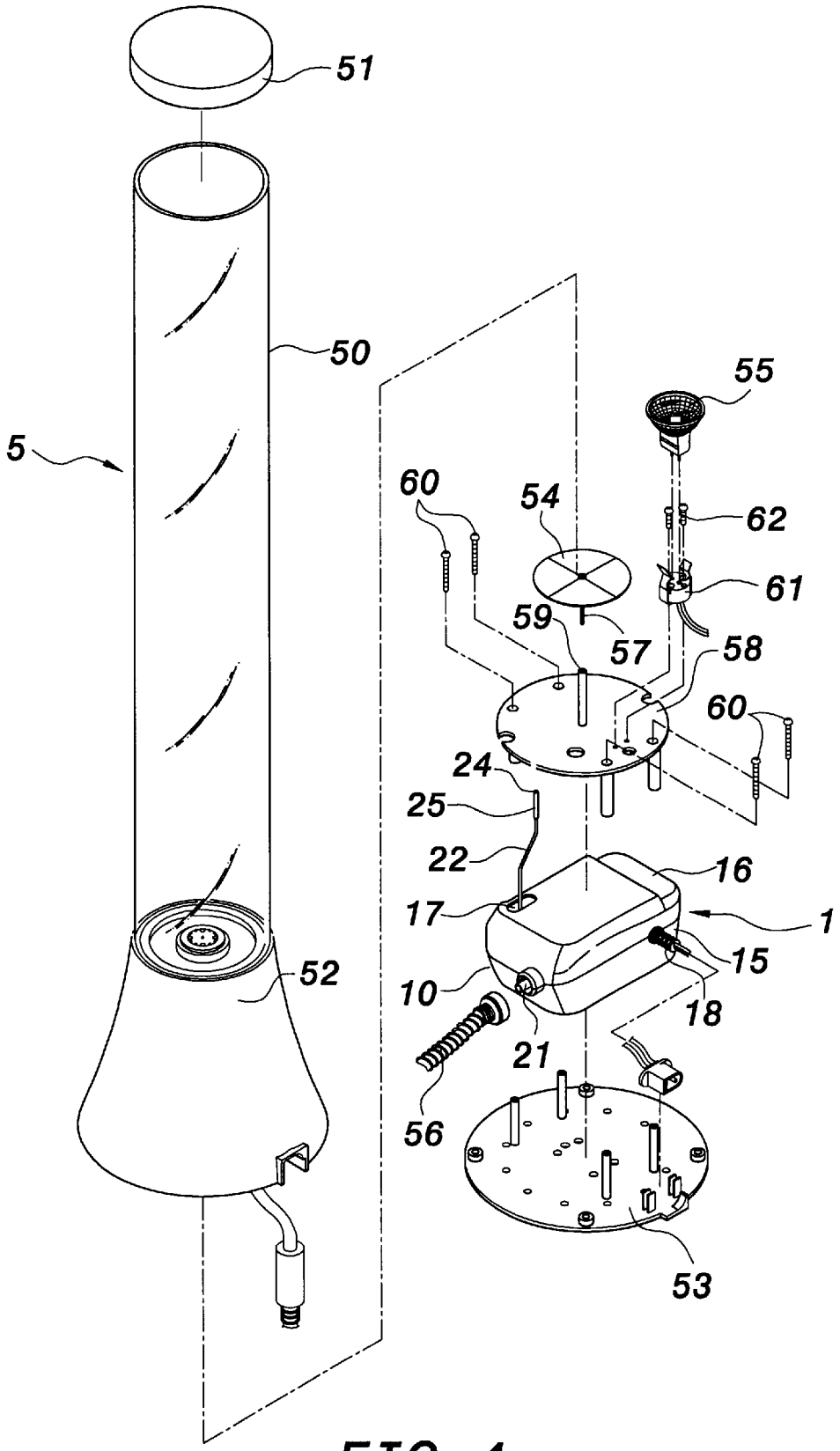
FIG. 4 is an exploded perspective view of the air pump of the present invention when installed in a water lamp.
Figure 5:
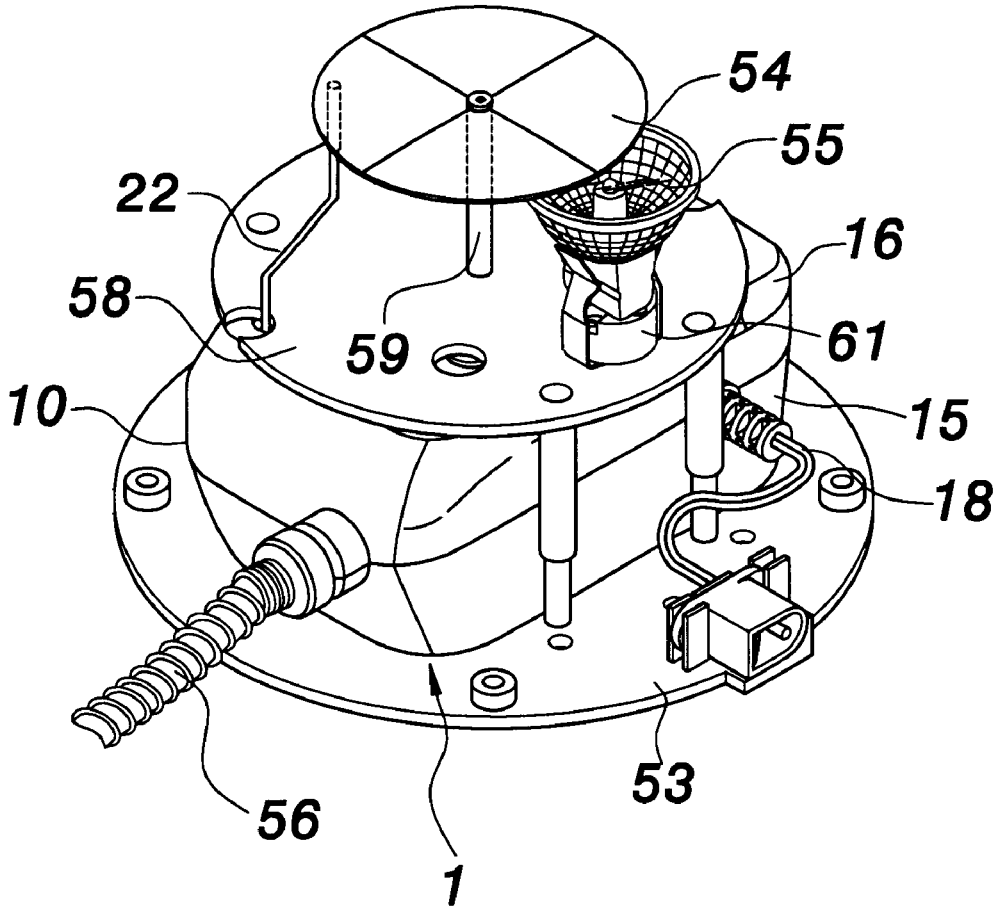
FIG. 5 is a partly perspective view of the air pump of the present invention when installed in a water lamp.
Figure 6:
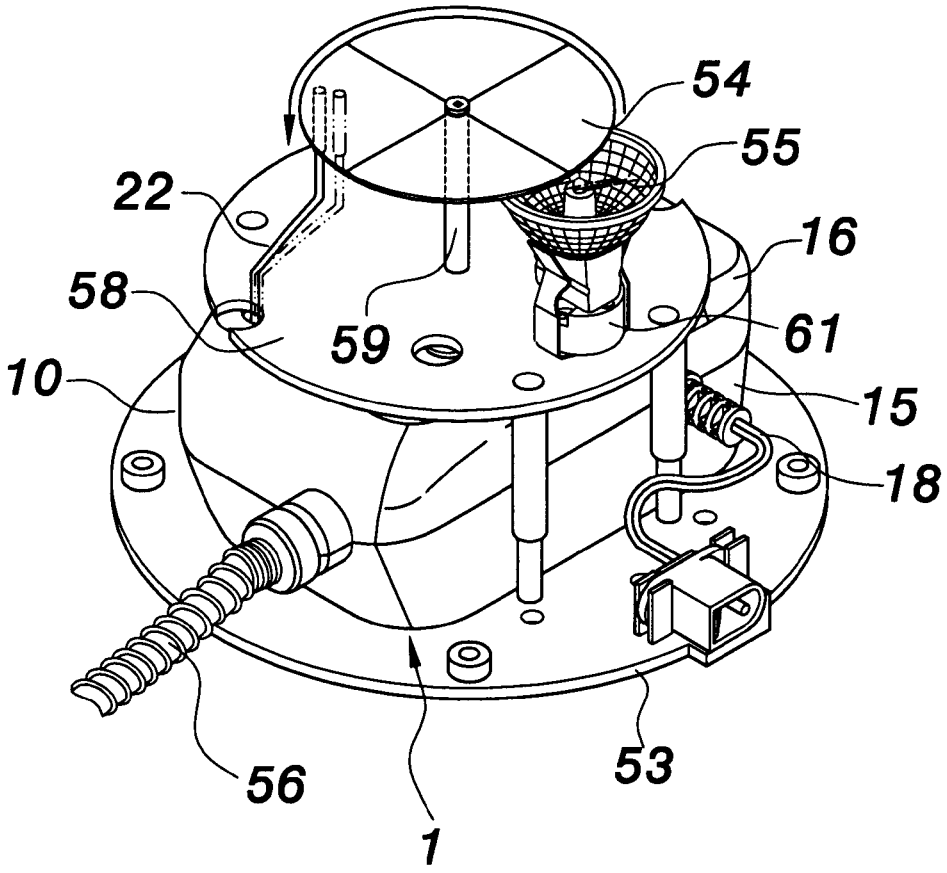
FIG. 6 is a diagram showing the action of the air pump of the present invention when installed in a water lamp.

As shown in FIGS. 4 and 5, the present invention can be applied to a water lamp 5 comprising a circular hollow container 50 made of transparent material. Water and decorative articles such as false fishes can be arranged in the container 5. The top end of the container 50 is open and matches a cover body 51. The bottom of the container 50 joins a bottom seat 52. The bottom seat 52 is a hollow body having an open bottom end. A bottom cover 53 can be used to seal the bottom end of the bottom seat 52 by means of screwing.

The air pump 1, a color disk 54, and a light source 55 are installed in the bottom seat 52 at the bottom of the container 50. The air pump 1 is fixed on the bottom cover 53. The air outlet 21 of the air pump 1 is connected to an air pipe 56. The other end of the air pipe 56 is connected to the bottom of the container 50. Air can be transported into the water in the container 50 to generate flow of water and air bubbles.

The color disk 54 has a color disk shaft 57 pivotally installed in a hollow pivotal bushing 59 of a fixing seat 58. Thereby, the color disk 54 is rotatably installed at the bottom of the container 50. The fixing seat 58 is fixed on the bottom cover 53 by screwing a plurality of screws 60. The light source (light bulb) 55 is inserted in a lamp seat 61, which is fixed on the fixing seat 58 by screwing a plurality of screws 62.

The air pump 1 can transport air into the water in the container 50 through the air pipe 56 to generate flow of water and air bubbles so that decorative articles such as false fishes (not shown) will seem to swim in the water. Thereby, vivid visual effects can be obtained. The color disk 54 can be led to rotate through the poked part 24 of the driving shaft 22. The light source 55 is installed below the color disk 54. When the light source 55 is turned on, light from the light source 55 will pass through the color disk 54 and then project to the container 50 and the water so that shining effect will be exhibited in the container 50 and the water. Therefore, novelty and variability can be obtained, and special visual effects can be exhibited.

To sum up, except that the air pump 1 of the present invention has air-supplying function, the driving shaft 22 protrudes to contact the color disk 54 or other devices of a water lamp so that the color disk 54 can be driven to rotate. Another motor is not required for driving the color disk to rotate, thereby saving the cost of another motor. Moreover, the structure of the whole water lamp can be much simplified, resulting in convenience in assembly and reduction in cost.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

I claim:

1. An air pump structure having driving effect, comprising:

a shell body;

a coil installed in said shell body and connected to a power wire;

a swing element installed in said shell body;

a magnet fixed at one end of said swing element and adjoining said coil;

a pump unit connected to said swing element; and a driving shaft connected to said swing element, one end of said driving shaft having a poked part, said poked part protruding out of said shell body.

2. The air pump structure having driving effect as claimed in claim 1, wherein said shell body comprises a lower shell and an upper shell.

3. The air pump structure having driving effect as claimed in claim 1, wherein a rectangular groove hole is formed on said shell body, and said poked part of said driving shaft protrudes out of said shell body via said groove hole.

4. The air pump structure having driving effect as claimed in claim 1, wherein said pump unit comprises an air room and a cover body made of rubber, said air room being fixed in said shell body, an air outlet extending from said air room, said cover body being telescoped at one end of said air room, said pump unit being connected to said swing element through said cover body.

5. The air pump structure having driving effect as claimed in claim 1, wherein a sheathing body can telescope outside said poked part of said driving shaft.

6. The air pump structure having driving effect as claimed in claim 1, wherein said poked part of said driving shaft contacts a color disk of a water lamp for driving said color disk to rotate.

* * * * *